United States Patent [19]

Sackett

[11] Patent Number: 4,615,303

[45] Date of Patent: Oct. 7, 1986

[54] FLUID FLOW FAILURE DETECTION MEANS

[76] Inventor: Robert L. Sackett, 2282 #43 Caminito Pescadio, San Diego, Calif. 92107

[21] Appl. No.: 722,849

[22] Filed: Apr. 12, 1985

Related U.S. Application Data

[62] Division of Ser. No. 572,907, Jan. 23, 1984, Pat. No. 4,524,736.

[51] Int. Cl.[4] ..... F02B 77/08; G01D 5/12; G01F 23/10

[52] U.S. Cl. ..... 123/41.15; 116/204; 116/228; 116/267; 73/308; 73/861.75

[58] Field of Search ..... 116/204, 227, 228, 229, 116/267, 275; 73/306, 307, 308, 861.74, 861.75, 861.76; 123/41.15, 198 D

[56] References Cited

U.S. PATENT DOCUMENTS

| | | | |
|---|---|---|---|
| 2,359,592 | 10/1944 | Stokoe | 73/861.75 |
| 2,600,309 | 6/1952 | MacDonald et al. | 73/861.75 |
| 2,826,914 | 3/1958 | Reiley | 73/861.74 |
| 3,046,475 | 7/1962 | Binford | 73/308 |
| 3,147,620 | 9/1964 | Stapler | 73/861.74 |
| 3,389,603 | 6/1968 | Jacobs | 73/308 |
| 3,559,197 | 1/1971 | Jarvis et al. | 73/861.74 |
| 3,857,277 | 12/1974 | Moore | 116/275 |
| 4,081,639 | 3/1978 | Tice | 73/308 |
| 4,290,059 | 9/1981 | Noyes et al. | 73/308 |

*Primary Examiner*—Ira S. Lazarus

*Attorney, Agent, or Firm*—Frank D. Gilliam

[57] ABSTRACT

A water flow failure detection device comprising a first water flow conduit; a second conduit with one end closed and the other end open communicating with the water flow conduit; positioned within the second conduit is a float which is free to translate therein. The float includes a permanent magnet positioned around its longitudinal mid-section; and a reed switch located on the external surface of the second conduit whereby the flow of water through the first conduit sufficiently raises or elevates the float away from the reed switch allowing the reed switch to return to its normal state and an absence of water flow causes the float to translate downward due to gravity to a location adjacent the reed switch thereby changing the state of the reed switch. The reed switch change of state can be used to terminate fuel or ignition to an engine or operates an alarm signal in the absence of cooling water flow through the engine. The device is also adaptable for use in detecting the volume of a liquid in a container.

13 Claims, 8 Drawing Figures

FLUID FLOW FAILURE DETECTION MEANS

This is a division, of application Ser. No. 572,907, filed 01/23/84, now U.S. Pat. No. 4,524,736.

BACKGROUND OF THE INVENTION

1. Field of the Invention

The invention generally relates to a means for sensing the failure of a normal fluid flow through a conduit and more particularly a sensing means which is readily adaptable for the use in sensing the failure of cooling water flow to an internal combustion engine and levels of fuel in fuel tanks.

2. Description of the Prior Art

The cooling of engines by the continual flow of cool water therethrough is popular particularly in the cooling of marine engines because of the availability of water useable for this purpose.

The use of external water for the cooling of marine engines is not without its problems. In both ocean and fresh water vessels that have engines cooled in this manner there is a continual problem with debris being sucked against the input filter of debris actually being ingested into the external cooling water passages in the engine either terminating the water flow through the engine or impeding water flow to a degree that cooling is ineffective.

Presently engine temperature is monitored and when a predetermined temperature level occurs the operator of the boat, if he notices the increased level, immediately shuts down the engine to prevent overheating or the problem causing the overheating is located and corrected before the temperature reaches an engine damaging level. If the operator does not notice the overheating, the engine is eventually seriously damaged or destroyed by excessive heat or the external water pump impeller is damaged. Also, because the external water is used to cool the exhaust leaving the engine, the flexible exhaust pipe couplers can be damaged from overheating and could cause an onboard fire.

It has been found that the temperature sensing method normally employed is not always effective in preventing some damage to the engine. In some instances, the location of the temperature sensor does not give a true indication of the concerned areas of the engine and while the temperature of the engine indicated is not at an engine damaging level the parts of the engine's external cooling system may have already suffered some damage.

Another problem of concern to the vessel owner is pollution of the surrounding water when fueling the vessel, inadvertent spilling of fuel while filling onboard tanks results in water pollution and may result in heavy fines levied by the United States Coast Guard. The problem arises from the lack of adequate monitoring of the tank fuel level during filling. The fuel for filling is supplied from a dock side source at a tremendous flow rate and most ship board fuel level indicators even if properly operating will not properly react to this extreme fuel fill flow rate.

Single and multiple temperature sensors have been used to detect engine overheating with some success; however, there is a continuing need to improve the prevention of engine overheating.

SUMMARY OF THE INVENTION

It is an object of this invention to detect the failure of fluid flow through a conduit and provide an immediate signal responsive thereto.

It is another object of this invention to provide an inexpensive means to terminate the operation of an internal combustion engine using the flow of external water for cooling when that water flow is terminated for any reason.

A still further object of this invention is to provide an inexpensive means for the instantaneous monitoring of fuel tank fuel levels while fueling and during running.

The apparatus of the instant invention employs a simple float which is inserted and freely translatable within a conduit connected to and elevated from the conduit through which cooling water flows. The float carries about its longitudinal center a permanent magnet which interacts with a reed switch positioned on the external surface of the conduit housing the float. When the water flow in the conduit through which the cooling water flows is normal the float will be elevated to a level in the conduit housing whereby the magnet carried thereon will have no effective influence on the reed switch. When the water flow through the conduit is terminated or substantially reduced the float by the effect of gravity will translate downward within its housing conduit with the water level wherein the magnet will become positioned substantially adjacent to the reed switch thereby influencing the reed switch to change its state either from normally open to closed or normally closed to open. The selected change in the state of the reed switch may be used to activate an alarm, terminate fuel flow or ignition to an engine or the like.

Further objects and advantages of the instant invention will become apparent as the following description proceeds and the features of the novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DETAILED DESCRIPTION OF A PREFERRED EMBODIMENT

The same numerals are used throughout the specification and drawing Figures to designate the same or similar element or part.

Figure 1:
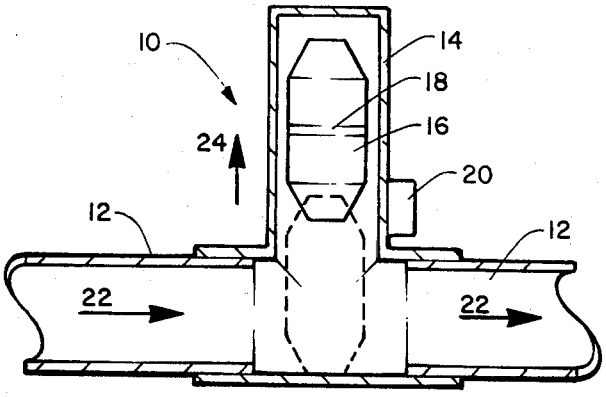
FIG. 1 depicts a schematic showing of a first embodiment of the sensing device the invention.

In FIG. 1 a schematic rendering of the flow failure sensor 10 is shown. The sensor 10 includes a conduit 12 which is the normal flow path of the fluid flow to be monitored. Stanchion tube 14 is connected to and communicates with the fluid flowing through tube 12. The diameter of the tube 14 does not have to be equal in diameter with conduit 12 although in some uses it may be. The material of construction of stanchion tube 14 must be a material that will not effect the passage of magnetic forces therethrough as hereinafter discussed in more detail. Positioned within the stanchion tube 14 is a float 16. The float 16 is configured to freely translate within stanchion tube 14 either by the fluid present flowing through conduit 12 or by the effect of gravity when no fluid is present due to flow failure. The float may be constructed of any suitable material provided that material allows the float to have a specific gravity less than that of the fluid flowing through conduit 12. The float may be constructed of plastic, wood, cork, hollow metal or the like.

Carried by the float 16 at substantially its longitudinal center is a permanent magnet 18. The exact position of the magnet 18 along the length of float 16 is not critical except that it must have an influencing relationship with a reed switch 20 when fluid ceases to flow through conduit 12 (hereinafter discussed in greater detail).

Reed switch 20 is positioned on the external surface of the stanchion tube 14. The reed switch 20 is a magnetically operated switch which is readily available in the marketplace. The reed switch 20 may be either the normally open type shown in FIG. 6 or the normally closed type shown in FIG. 7.

Figure 6:
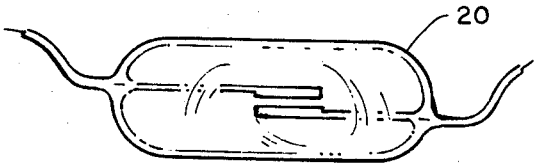
FIG. 6 is a schematic showing depicting a normally open reed switch.
Figure 7:
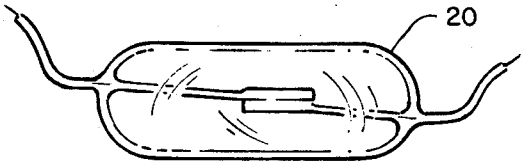
FIG. 7 is a schematic showing depicting a normally closed reed switch.

As should be readily understood, the flow of fluid through conduit 12 along arrows 22 is forced into stanchion tube 14 causing the float 16 to rise along arrow 24 thereby moving the magnet 18 to a non-reed switch 20 influencing location, whereby the normal state of the switch remains as shown in either FIGS. 6 or 7. When for whatever reason, the fluid either ceases to flow along arrows 22 or the flow pressure is decreased sufficiently so that the fluid does not rise in stanchion tube 14 then the effect of gravity on float 16 causes the float to translate in a direction opposite to arrow 24 to the phantom position shown in FIG. 1. The translation of the float 16 to the non-fluid flow position effectively places the reed switch 20 within the field of influence of the magnet 18. The magnet's influence causes the reed switch 20 to change state. The reed switch of FIG. 6 changes from its normally open state where no electrical continuity through the switch is achieved, to a closed state, the normal state of the reed switch of FIG. 7, where continuity through the switch is achieved. The reed switch of FIG. 7 changes from its normally closed state where continuity through the switch is achieved to an open state, the normal state of the reed switch of FIG. 6, where no electrical continuity through the switch is achieved.

The type of reed switch 20 selected is determined of the type of sensing required to operate an external device.

Figure 2:
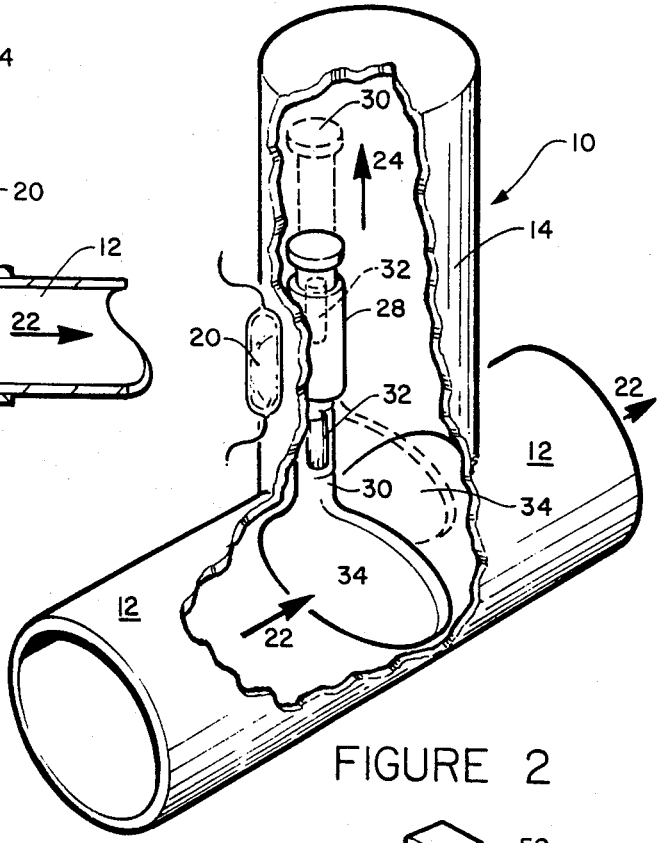
FIG. 2 depicts a perspective showing of a second embodiment of the sensing device of the invention.

The failure flow sensing device 26 of FIG. 2 operates in substantially the same manner as that shown in FIG. 1. A stanchion 14 is inter-connected to and communicates with the fluid flowing through the tube 12 in the direction of arrows 24. The materials of construction of the stanchion 14 and its diameter relative to tube 12 are the same as discussed above. A similar reed switch 20 is positioned on the external surface of stanchion 14 as discussed above. A hollow tube 28 is attached to the inner surface of stanchion 14. Within the tube 28 is a freely translatable rod 30. The rod 30 includes a permanent magnet 32 positioned on the rod intermediate its ends whereby the magnet translates with the rod while staying within the tube 28. The distal end of the rod 30 adjacent the tube 12 carries a circular plate 34 at an angle relative thereto. The circular plate 34 has a diameter similar to the diameter of tube 14.

As discussed above as fluid flows along arrows 22 in tube 12, the flow forces plate 34 upward translating the rod 30 in the direction of arrow 24 to a position shown in phantom thereby translating magnet 32 out of the field of influence on reed switch 20 causing the reed switch to change to its normal state. Likewise, the termination of the fluid flow through tube 12 causes the rod 32 to translate by the effect of gravity against arrow 24 to its FIG. 2 position. The magnet 32 is now in a position to influence the reed switch 20 change from a normal state to an activated state, as hereinbefore and hereinafter discussed in more detail.

Figure 3:
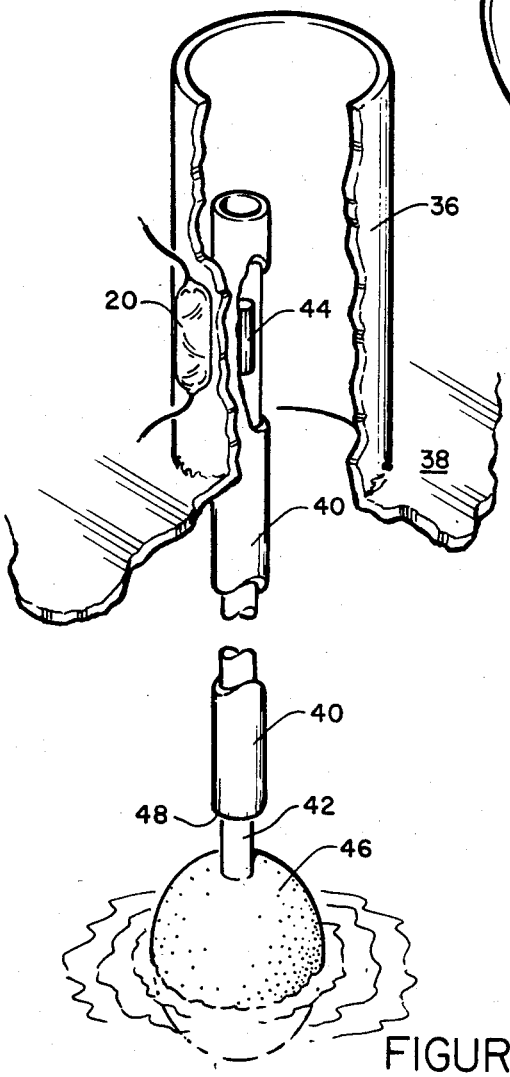
FIG. 3 depicts a perspective showing of a third embodiment of the sensing device of the invention.

The device of the FIG. 3 embodiment is shown installed in a series fuel filler conduit 36 of a marine fuel tank 38. The device consists of an elongated hollow tube 40 fixedly secured to the inner surface of the fuel filler conduit 36 and extends into the fuel tank 38. Translatable within tube 40 is a rod 42 with a permanent magnet 44 at its upper end and a float member 46 at its lower end. The length of rod 42 is chosen so that when the fuel tank 38 is substantially full of fuel the magnet 44 influences the state of reed switch 20 located on the outside of fuel filler conduit 36. The reed switch can be used to operate visual indicators and sound alarms which indicate the maximum fuel full state of a tank prior to overflow (fuel spill).

Figure 4:
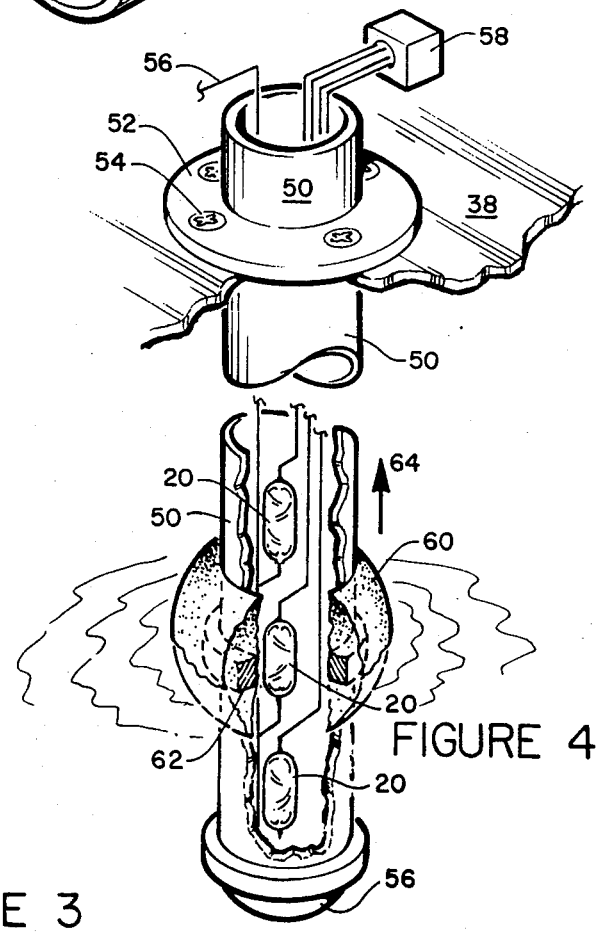
FIG. 4 depicts a perspective showing of a fourth embodiment of the sensing device of the invention.

Referring now to FIG. 4, the device like the device of FIG. 3, is shown installed in a fuel tank 38; however, in this Figure the fuel filler neck 36 is independent thereof. The device of FIG. 4 consists of a tube 50 extending into and out of the tank 38. The tube is removably secured through an opening in the tank by plate 52 which is secured to the tube 50. The plate is secured to the upper surface of the tank by any convenient means. Screws 54 are shown for ease of explanation. The tube 50 is sealed at end 56. Positioned within the tube 50 are four reed switches 20. It should be understood that more or less than the number shown could be employed to satisfactorily practice the invention. The four-reed switches 20 shown are location positioned to provide fuel level indications at quarter tank increments. Each reed switch is connected to a common voltage source 56 and has a separate lead at its opposite end to a visual indicator 58. Obviously, the indicator will receive the voltage from the source through a reed switch in a closed state and no voltage when in an open state thereby providing a visual indication of switch state. It should be understood that the device of FIG. 4 can be used equally as well as a portable device for fuel measurement much like a dip stick.

A float 60 has an internal permanent magnet 62. Because the specific gravity of the float/magnet combination in less than the fuel in the tank, as the tank is filled with fuel the float 60 will elevate upward in the direction of arrow 64. As each reed switch 20 is influenced by the magnet 62 that reed switch will change from a normally open state, see FIG. 6, to a closed state, see FIG. 7, and voltage through that reed switch will be received by visual indicator 58. The reverse will occur when fuel is being depleted from tank 38 and the float is moving along tube 50 in a direction reverse to arrow 64.

Figure 5:
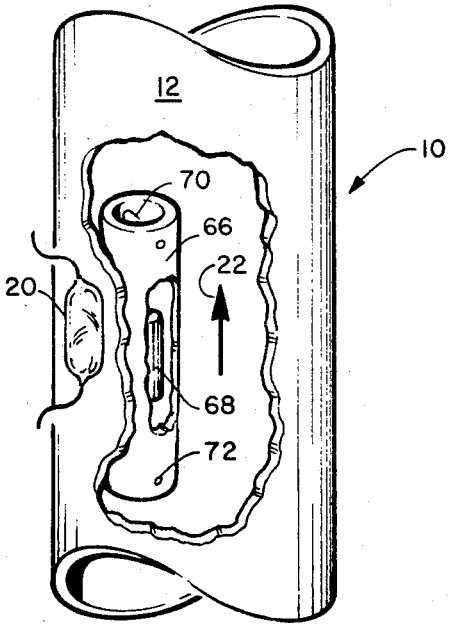
FIG. 5 depicts a perspective showing of a fifth embodiment of the sensing device of the invention.

Referring now to FIG. 5, the device of this figure is employed to monitor vertical fluid flow at angles above approximately 45° from the horizontal. The devices of FIGS. 1 and 2 would be inoperable for vertical flow because of the lack of the effect of gravity on the floats at angles greater than approximately 45° to the horizontal.

In the device of FIG. 5 tube 12 is vertical and fluid flow therein is along arrow 22. A hollow tube 66 is affixed to the inner wall of the tube 12. Within the tube 66 is a magnet 68. The composition of the magnet is such that the normal flow of fluid elevates the magnet 68 against pin stop 70 at the top of the tube 66 and gravity translates the magnet 68 against stop pin 72 at the bottom of tube 66. As discussed above, a reed switch 20 is attached to the outer surface of tube 12 adjacent the normal position of the magnet when fluid ceases to flow through tube 12. It should be obvious that the state of reed switch 20 changes with translation of the magnet 68.

Figure 8:
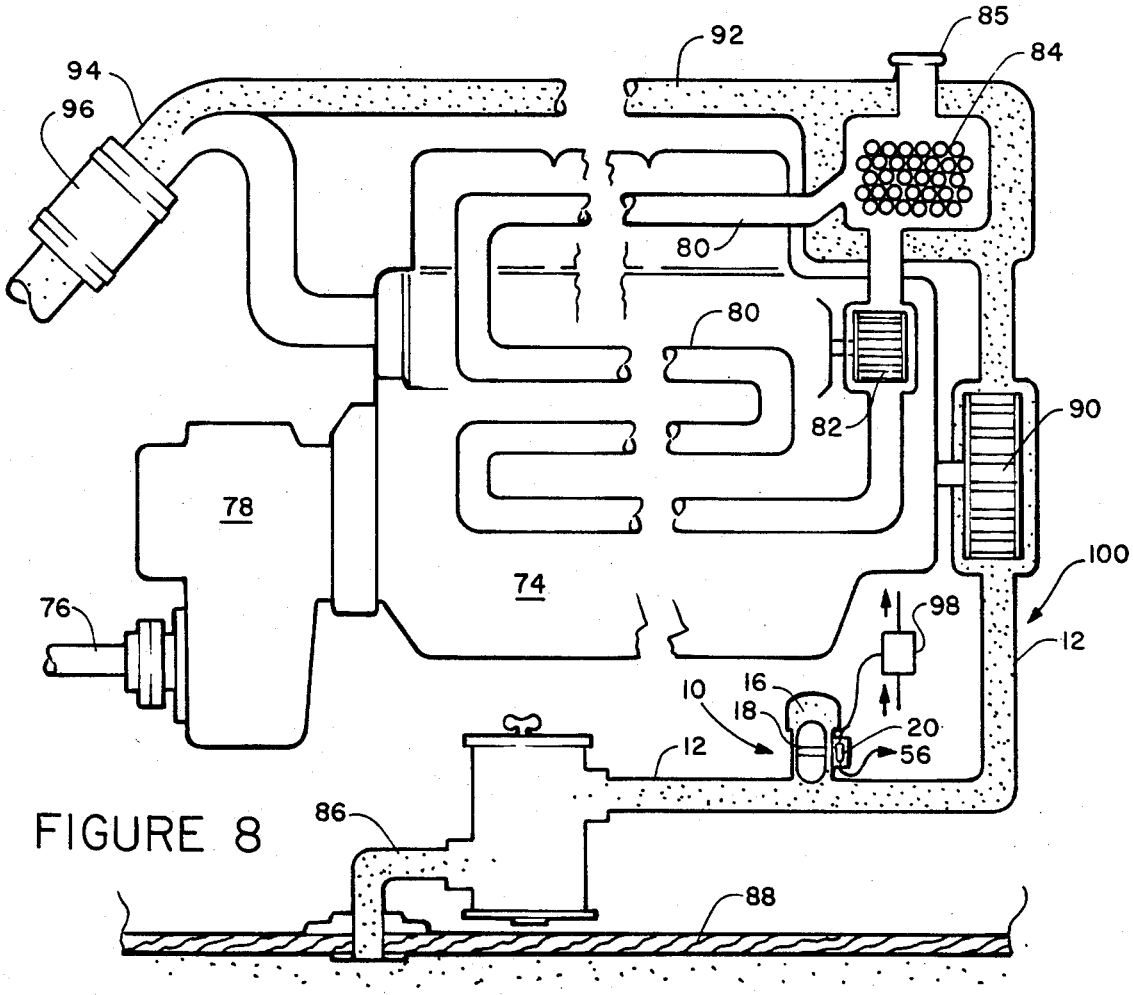
FIG. 8 is a schematic showing depicting the failure of flow indicator utilized in a marine engine cooling system.

FIG. 8 depicts a schematic showing of a principle use of the fluid flow failure devices of the FIGS. 1, 2 and 5.

A marine engine 74 is shown in cross-section. The engine is coupled to a shaft 76 through a transmission 78. The engine includes a standard fresh water cooling system 80 which includes a circulation pump 82 and a radiator 84. The fresh water system is filled through filler 85. The engine further includes an external water cooling system employing the water on which the vessel carrying the engine 74 travels, ie., either fresh or salt water. The external coolant water is drawn in through conduit 86 passing through the bottom 88 of the vessel in a conventional manner. The incoming water passes through conduit 12 through a device 10 of the invention, the FIG. 1 device employed for convenience of discussion, through the pump 90, around radiator 84, out through conduit 92 and into exhaust conduit 94 where it aids in the cooling of the exhaust gases exiting the vessel. The conduit 94 is interconnected along its length by flex couplings 96, one shown, to allow relative flexing of the exhaust conduit. The flex couplings 96 are generally constructed of, for example, and not by way of limitation, rubber, canvas or the like all of which are flammable material. The device 10 operates in the manner hereinbefore discussed. The float 16 is elevated when water flows through conduit 12 translating magnet 18 out of its range of influence on reed switch 20. When water ceases to flow through conduit 12 the float 16 drops under the influence of gravity changing the state of reed switch 20. The change of state of the reed switch at no fluid flow may be used to sound alarms by applying a voltage from source 56 through the reed switch, operate a fuel shut off solenoid valve, terminate the ignition voltage to the engine or the like, generally represented by block 98 for convenience. The operation of the devices and/or switch and/or valves are conventional and well known.

The device 10 shown in FIG. 5 could be utilized in the vertical section of conduit 12 adjacent arrow 100 for the same purpose as the device 10 shown in the horizontal section of conduit 12.

The devices of FIGS. 3 and 4 are generally used to detect levels of a stationary liquid in a tank rather than flow and could, therefore, be utilized to prevent fuel overflow or detect fluid levels within a tank.

It should be understood that the closed loop cooling system 80 of the engine could be monitored in the same manner as the external cooling water as shown and discussed.

Many changes may be made in details and materials of fabrication, in the configuration and assemblage of the constituent elements, without departing from the spirit and scope of the appended claims, which changes are intended to be embraced therewithin.

Having thus described the invention, what is claimed as new and useful and desired to be secured by United States Letters Patent is:

1. Apparatus for detecting the failure of the flow of fluid comprising:

a first tubular conduit through which said fluid normally flows;

a second tubular conduit positioned intermediate the ends of said first tubular conduit and communicating with the flow through said first tubular conduit;

a translating member freely translatable within at least said second tubular conduit, the position of said translating member is influenced by the elevation of fluid in said second tubular conduit resulting from the force of fluid flow in said first tubular conduit;

a permanent magnet positioned on said translating member;

a switch having an open and closed state positioned externally of said second tubular conduit whereby the position of said permanent magnet relative to said switch influences the state of said switch; and an external indicator means interconnected to said switch, a reduction of the elevation of fluid in said second tubular conduit due to a reduction of fluid flow through said first tubular conduit changes the state of said switch causing said indicator means to be activated.

2. The invention as defined in claim 1 wherein one end of said second tubular conduit is closed to fluid flow.

3. The invention as defined in claim 1 wherein said translating member has a specific gravity less than the fluid flowing through said first tubular conduit.

4. The invention as defined in claim 1 wherein said switch is positioned on the outer surface of said second tubular conduit.

5. The invention as defined in claim 1 wherein said translating member is positioned within said second tubular conduit.

6. The invention as defined in claim 1 wherein said fluid means is a liquid.

7. The invention as defined in claim 1 wherein said permanent magnet is positioned substantially at the longitudinal center of said translating member within said second tubular conduit.

8. The invention as defined in claim 1 wherein said switch means is a reed switch.

9. The invention as defined in claim 1 wherein said float has frustum shaped ends.

10. The invention as defined in claim 1 wherein said indicator means is an alarm means.

11. The invention as defined in claim 1 wherein said fluid flows through both of said first and second conduit means.

12. The invention as defined in claim 1 wherein said translating member is moveable within said first and second conduit.

13. Apparatus for detecting various fluid levels in a container comprising:

a conduit sealed from communication with the fluid in said container;

a float surrounding said conduit and moveable therealong, said float having a specific gravity less than that of the fluid in said container whereby the position of said float is influenced by the level of said fluid in said container, said float includes a magnet associated therewith; and a plurality of switches each having an open and closed state and positioned within said conduit whereby the position of said magnet adjacent to any one of said plurality of switches changes the state of that switch.

* * * * *